United States Patent [19]

Smalley

[11] 3,976,215

[45] Aug. 24, 1976

[54] EASY-OPEN, TAMPER-INDICATING CLOSURE

[75] Inventor: Ned J. Smalley, Perrysburg, Ohio

[73] Assignee: Owens-Illinois, Inc., Toledo, Ohio

[22] Filed: Mar. 21, 1975

[21] Appl. No.: 560,708

[52] U.S. Cl. ..... 215/253; 215/305

[51] Int. Cl.[2] ..... B65D 41/32

[58] Field of Search ..... 215/253, 254, 256, 305

[56] References Cited

UNITED STATES PATENTS

| | | | |
|---|---|---|---|
| 3,465,906 | 9/1969 | Wagner | 215/253 |
| 3,589,543 | 6/1971 | Weigand | 215/253 |
| 3,672,527 | 6/1972 | Bly | 215/253 |
| 3,750,820 | 8/1973 | LaBarre | 215/253 |
| 3,820,678 | 6/1974 | Zipper | 215/253 |
| 3,858,742 | 1/1975 | Grussen | 215/253 |
| 3,865,268 | 2/1975 | Coop | 215/253 |
| 3,866,782 | 2/1975 | Westfall | 215/253 |

*Primary Examiner*—Ro E. Hart

*Attorney, Agent, or Firm*—A. J. Steger; E. J. Holler

[57] ABSTRACT

This disclosure relates to a tamper-indicating press-on, pull-off closure for maintaning pressure in a container whereby the closure and container provide a package which may be readily opened by a consumer without the use of tools and without the creation of dangerous sharp edges. This closure includes a cap and a unique cap liner which fits within the cap and is formed integral with a pull ring for removal of the cap from a container. A plurality of severable tamper-indicating webs are formed between the pull ring and the cap liner and sever upon actuation of the ring pull to indicate tampering with the package. The cap incorporates a plurality of scores in its skirt portion which fracture when the pull ring is actuated to thereby release the cap from engagement with the container.

1 Claim, 3 Drawing Figures

EASY-OPEN, TAMPER-INDICATING CLOSURE

BACKGROUND OF THE INVENTION

This invention relates to container closures and, more specifically, it relates to a tamper-indicating press-on, pull-off closure for maintaining pressure in a container whereby the closure and container provide a package which may be readily opened by a consumer without the use of tools.

Several types of tamper-indicating closures are presently used for sealing a container and maintaining pressure in the container. These types of closures are particularly needed in conjunction with packaging beverages. One such type of tamper-indicating closure is a metal twist-off cap which incorporates a severable metal ring which fractures upon twisting of the closure so as to remain on the container neck as a tamper-indicating band when the closure has been removed. This type of closure results in a sharp edge remaining on the closure portion which has been removed and on the tamper-indicating band which remains on the container. These sharp edges are inherently dangerous to the consumer utilizing the package. In addition, a twist-off closure requires more expensive and complicated application machinery than does a simple push-on closure.

Another type of tamper-indicating closure is the pull tab which involves severing a portion of the closure in the form of a pull tab, thereby releasing the pressure from within the container. The closure may then be pulled from engagement with the container by means of the pull tab. This type of closure also is inherently dangerous, as a sharp edge is formed both on the pull tab and on the opening formed in the closure. Thus, there has been a long felt need in the packaging art for a press-on, pull-off closure which incorporates a tamper-indicating feature and eliminates any sharp edges remaining after removal of the closure.

SUMMARY OF THE INVENTION

It is, therefore, an object of this invention to provide a tamper-indicating press-on, pull-off closure for maintaining pressure in a container whereby the closure and container provide a package which may be readily opened by a consumer without the use of tools and without the creation of dangerous sharp edges.

The closure of this invention includes a cap and a unique cap liner which fits within the cap and is formed integral with a pull ring for removal of the cap from the container. The pull ring is connected to the cap liner by means of a hinge and also by a plurality of severable tamper-indicating webs which sever upon actuation of the ring pull to indicate tampering with the package. The cap incorporates a plurality of scores in its skirt portion which fracture when the pull ring is actuated to thereby release the cap from engagement with the container. It is suggested that the cap be formed from metal and the cap liner and pull ring be formed from flexible plastic.

Other objects, features and advantages of the subject invention will become apparent to one skilled in the art upon reference to the following detailed description of the invention and the drawings illustrating a preferred embodiment thereof.

DETAILED DESCRIPTION OF A PREFERRED EMBODIMENT

Figure 1:
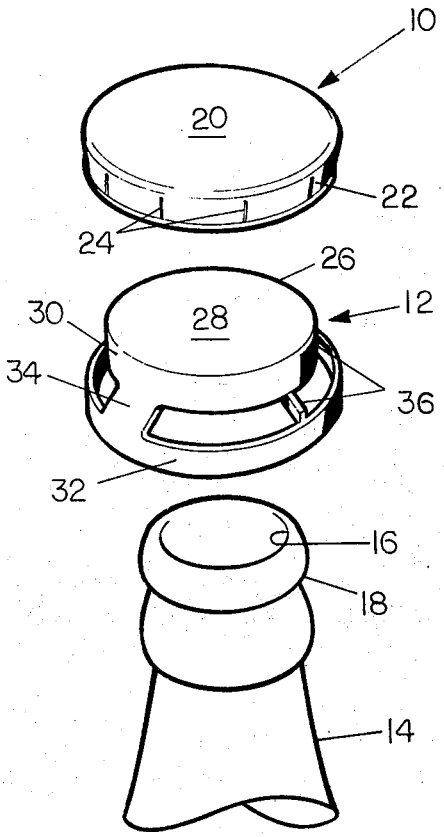
FIG. 1 is a perspective view of a cap, cap liner and ring pull member, and container neck formed in accordance with the teachings of the present invention.

A closure which embodies the teachings of this invention is formed from two separate members, a cap member 10 and an integral cap liner and ring pull member 12. The closure of this invention is adapted to be pressed into sealing engagement with a neck portion 14 of a container which terminates at its upper end in an open mouth 16 and incorporates a sealing bead 18 adjacent to the open mouth 16.

The cap member 10 incorporates a top wall 20 which is sized to span and completely cover the open mouth 16 on the container neck 14. A skirt portion 22 is formed integral with the top wall 20 and depends downwardly therefrom around the entire circumference of the top wall 20. The skirt portion 22 is adapted to surround and engage the sealing bead 18 on the container neck 14 when the closure is pressed thereon. A plurality of fracturing scores 24 are formed in the skirt portion 22 of cap 10 and are adapted to fracture upon the application of sufficient force to enable the removal of the cap member 10 from sealing engagement with the container neck 14.

The integral cap liner and ring pull member 12 includes a generally cup-shaped liner portion 26 which features a top wall 28 and a depending skirt 30 which are adapted to fit snugly within the cap member 10 and fit flushly against the interior surfaces of the top wall 20 and skirt 22, respectively, of the cap member 10. The liner portion 26 serves as a seal between the cap member 10 and the container neck 14 when the cap member 10 is pressed into engagement with the sealing bead 18 on the container neck 14. A ring pull portion 32 is formed integrally with the cap liner portion 26 and securely attached thereto by means of a hinge member 34. The ring pull 32 is also connected to the cap liner portion 26 by means of a plurality of severable tamper-indicating webs 36. Thus, when cap liner portion 26 is pushed within the cap member 10 and the combination pressed into sealing engagement with the sealing bead 18 on the container neck 14, the closure and container combination form a package which will maintain pressure within the container.

It should be noted that while the closure of this invention is designed specifically to be opened by a consumer without the use of tools, it may be readily opened by means of any suitable beverage cap removal tool. Such a tool could be utilized by having a portion of the tool rest against the top wall 20 of the closure of the cap member 10 while another portion is pushed under the lower edge of the skirt portion 22 to thereby lift the skirt portion to vent the container and lift the closure out of engagement with the container.

Figure 2:
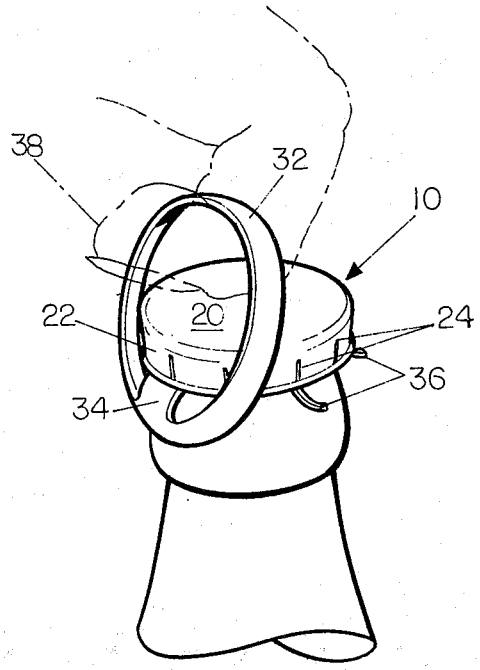
FIG. 2 is a perspective view of the closure of this invention in sealing engagement with a container neck finish with the ring pull member illustrated in the initial stages of the removal procedure.
Figure 3:
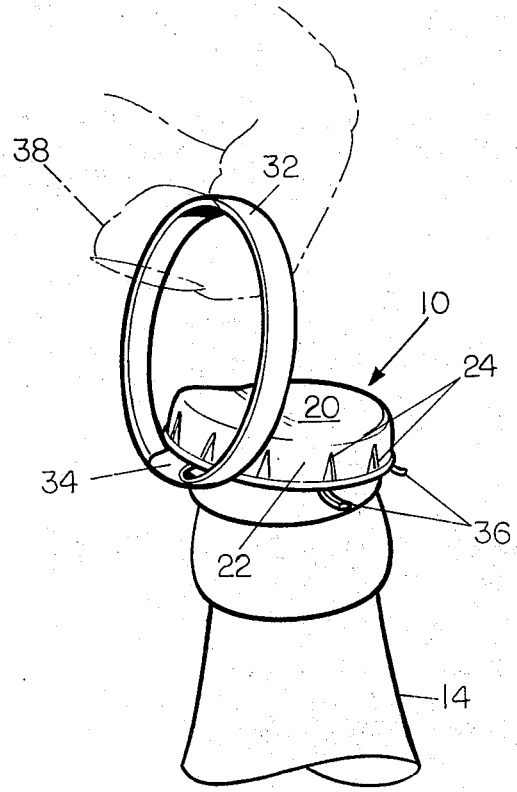
FIG. 3 is a perspective view of the closure of this invention as it is being removed from engagement with a container neck finish.

However, the unique closure of this invention incorporates its own pull-off removal means and a tamper-indicating feature to indicate to the consumer possible previous tampering with the package. As can be seen in FIG. 2, the ring pull portion 32 may be bent upwardly with respect to the cap member 10 by pivoting it about the hinge member 34. When the ring pull portion 32 is pulled upwardly, the tamper indicating webs 36 are severed, thereby serving as a visual indicator to the consumer that the package may have previously been opened. Once the ring pull 32 has been pivoted to the position shown in FIG. 2, the consumer may insert his finger, indicated schematically as numeral 38, through the hole in the ring pull 32. When an upward force is asserted on the ring pull 32, the scores 24 in the skirt portion 22 of cap member 10 begin to fracture as shown in FIG. 3 Once the cap member 10 has been pulled out of sealing engagement with the container neck 14, the container becomes vented, thereby releasing the pressure therein. The cap member 10 may be removed from the container neck by continued upward movement of the ring pull. Thus, it can be seen from the preceding description that the closure of this invention incorporates its own unique removal method which facilitates easy removal of the closure and also incorporates a tamper-indicating feature. Once removed, the resulting ring pull and closure of this invention has no sharp edges exposed which could result in injury to the consumer.

It should be noted that the closure of this invention may be applied by any of the standard press-on closure application machinery available and does not require the use of more expensive and complicated twist-on applicating machinery. However, to ensure a maximum crimp of the cap on the glass finish needed to hold the pressure in some of the highly carbonated soft drinks (storage in high temperature) a specially designed capping head is available which applies the cap as a straight throat capping head and then crimps or forces the wire at the cap skirt further under the glass finish bead.

I claim:

1. A tamper-indicating press-on, pull-off closure for maintaining pressure in a container, said container including a neck portion with a sealing bead thereon and an open mouth at the upper extremity thereof, said closure comprising:

a plastic inner cap having a top wall spanning the open mouth of said container and a depending circumferential skirt surrounding and engaging the neck portion of said container;

a ring pull member formed integral with said inner cap, said ring pull being connected to and depending downwardly from the lower free edge of the circumferential skirt of said inner cap by means of a hinge and at least one severable, tamper-indicating web which severs upon actuation of said ring pull member to remove said inner cap from engagement with said container neck;

an outer metal cap adapted to snugly fit over said inner cap and having a top wall overlying the top wall of said inner cap and spanning the open mouth of said container and a depending circumferential skirt surrounding the depending circumferential skirt of said inner cap and being crimped into holding engagement with the sealing band on said container neck to thereby retain said inner and outer caps in sealing engagement with said container neck to maintain pressure within said container, and said outer cap including at least one score in its skirt which fractures upon actuation of the ring pull member to thereby release the outer cap from engagement with the container neck.

* * * * *